United States Patent [19]

Fukase

[11] 4,087,676

[45] May 2, 1978

[54] FIXING APPARATUS WITH HEAT AND PRESSURE FOR ELECTROPHOTOGRAPHIC COPIERS

[75] Inventor: Yasuji Fukase, Ebina, Japan

[73] Assignee: Rank Xerox Ltd., London, England

[21] Appl. No.: 766,817

[22] Filed: Feb. 8, 1977

[30] Foreign Application Priority Data

Dec. 26, 1975 Japan ..... 50-154720

[51] Int. Cl.[2] ..... H05B 1/00; G03G 15/20

[52] U.S. Cl. ..... 219/216; 219/469; 432/60; 432/228

[58] Field of Search ..... 219/216, 388, 469–471; 432/75, 60, 228; 355/3 FU; 118/60

[56] References Cited

U.S. PATENT DOCUMENTS

| | | | |
|---|---|---|---|
| 3,811,821 | 5/1974 | Ariyama et al. | 219/216 X |
| 3,874,843 | 4/1975 | Fujimoto | 219/216 X |
| 3,935,836 | 2/1976 | Bar-on | 118/60 |
| 3,945,726 | 3/1976 | Ito et al. | 219/216 X |

*Primary Examiner*—C. L. Albritton

[57] ABSTRACT

A fixing apparatus with heat and pressure for electrophotographic copiers, the apparatus comprising a first roll 1, with which a toner image 11 on a paper 10 to be fixed comes into contact, and a second roll 2 placed in pressure contact with said first roll for rotation, said paper 10 passing between both the rolls 1 and 2, characterized in that a heat generating source 3b is provided at least in the second roll 2, a resilient material 5 having a heat-resistant releasing property is coated on the surface of the first roll 1, the surface of the second roll 2 being formed into a metal surface, and a releasing agent 7 containing a functional group is supplied to at least the surface of the second roll 2.

1 Claim, 1 Drawing Figure

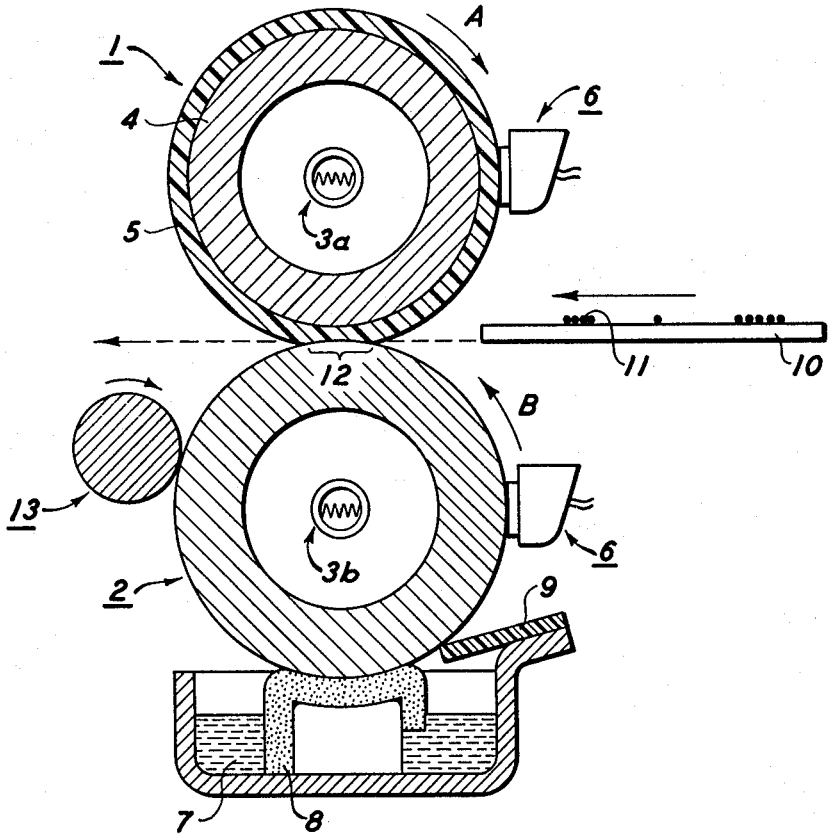
A
1
4
6
5
3a
11
10
12
B
13
6
3b
2
9
7
8

FIXING APPARATUS WITH HEAT AND PRESSURE FOR ELECTROPHOTOGRAPHIC COPIERS

BACKGROUND OF THE INVENTION

The present invention relates to a fixing apparatus with heat and pressure for electrophotographic copiers.

In accordance with a general process employed in electrophotographic copiers, a toner image is electrostatically formed on a photosensitive member, and said toner image is transferred to a transfer paper, after that, it is fixed. Fixing apparatus for fixing the toner image heretofore employed is a fixing apparatus with heat and pressure.

This apparatus has a structure such that a heating roll having a surface coated with a heat-resistant releasing material and a pressure roll having a heat resistance and a flexibility are brought into contact with each other by applying a given pressure to permit a paper to be fixed to pass therebetween.

Heat resistant releasing materials for the heating roll which have been known are tetrafluoroethylene (Teflon), silicone rubber, fluorocarbon resin, etc., and as the case may be, fixing is carried out while further forming a film such as a suitable silicone oil.

The heating roll coated with silicone rubber among these heat resistant materials is resilient in its surface so that smash or deformation of the toner may be minimized to obtain copies of good quality.

Such silicone rubber is roughly divided into at least two kinds from its vulcanization temperature. That is, there are room temperature vulcanized silicone rubber (RTV) and high temperature vulcanized silicone rubber (HTV), the RTV being generally better than the other in terms of the parting property relative to the toner. In the case of rolls currently used, the good parting property remains exhibited in the range of copies from about 5,000 to 30,000, but when the silicone components run dry, then unfavorable situations such as twining of paper round the offset or roll result.

On the other hand, application of silicone oil to the surface of the heating roll provides a significant effect in preventing offset, but both RTV and HTV are swelled by the presence of silicone oil to unfavorably induce deterioration of various properties and poor adhesion.

A method for heating a heating roll is also roughly divided into two methods, one of which is to heat the heating roll from the interior thereof and the other receiving heat from the external surface thereof.

In the former method, it is not complex in construction, but heat transmission inherent in the silicone rubber is so bad as to increase a temperature of adhesive interface with a core of the heating roll thereby inducing thermal deterioration of primer and deterioration of various properties. For this reason, a method has been proposed wherein rubber is formed into a multi-layer, into which thermally stabilized rubber is inserted. This method, however, results in an increase of manufacturing process and an increase of rubber wall from a thermal standpoint, which is not effective.

In the latter method, the external surface is highest in temperature so that the disadvantages noted above may be decreased. However, it is important how to enhance transmission efficiency to the external surface and it is also important how to minimize heat loss caused by an increase of the entire surface area. In addition, where an infrared heating source is used as the external heating source, there is a possible danger of fire caused by the paper when the latter is plugged or twined.

Further, most of such heat resistant releasing materials are small in heat conductivity, and hence, as compared to a heating roll which uses a metal surface without modification with respect to thermal transmission rate to the paper to be fixed, the temperature rise is slow internally of the transfer paper with which the heating roll comes into contact, as a consequence of which more heat is required to let it increase to the same surface temperature. However, the surface energy of the metal surface is extremely high and lends itself to what is called the offset phenomenon in which a part of toner image is adhered to the heating roll surface, and even if a film such as silicone oil is formed on the surface, the toner passes through the film to permit the toner to touch with the metal surface to induce offset, which is not practical.

In order to decrease the offset, there has been proposed a method for heating two rolls so as to provide a temperature gradient within the toner layer, that is, to semi-dissolve the toner surface while to dissolve the paper to be fixed. However, since the temperature conductivity of the paper to be fixed is extremely low, the roll on the side of the paper to be fixed must be held at a relatively high temperature, resulting in a poor thermal efficiency.

Further, for purposes of minimizing the aforesaid offset, all that need be done is at least not to allow the toner to come into contact with the surface of the heating roll. As for example, one method has been proposed, in which a functional group is introduced into a releasing agent such as silicone oil to effect chemical reaction with the surface of the metal roll thereby forming a cross link film of which low surface energy is formed to minimize offset. The functional group specifically used is a polyalkylsiloxane releasing agent containing mercapto group, carboxyl, hydroxyl group, epoxy group, amino group, isocyanate group, and thioether, and metals well-used are iron, copper, aluminum, zinc titanium, silver, etc. In this case, thermal transmission efficiency may be increased to decrease electric power required, while the surface is formed with a hard metal to smash the toner conversely to the resilient surface such as silicone, resulting in the lowering of image quality such as an increase of background density of the image.

BRIEF SUMMARY OF THE INVENTION

The present invention has been realized in view of circumstances noted above, and it is an object of the invention to provide a fixing apparatus with heat and pressure for electrophotographic copiers, wherein a first roll, which comes into contact with a toner image on a paper to be fixed, has a surface coated with a heat resistant resilient releasing material while a second roll arranged on the side not placed in contact with the toner image comprises a metal roll, a heating source is provided at least in the second roll, and a releasing agent having a functional group is supplied to the second roll, thereby enabling to increase thermal transmission efficiency without lowering image quality, to enhance durability of apparatus, and to simplify apparatus.

DETAILED DESCRIPTION OF THE DRAWING

The drawing is a schematic section of a heating, contacting and fixing device according to the present invention.

DETAILED DESCRIPTION OF THE PREFERRED EMBODIMENT

The present invention will now be described by way of a preferred embodiment.

The attached FIGURE is a schematic sectional view showing one embodiment according to the present invention. A first roll indicated as at 1 rotates in the direction of arrow A while a second roll indicated as at 2 rotates in the direction of arrow B. The first roll 1 is internally provided with a heating source 3*a* and has a metal core 4 on which silicone rubber 5 is coated. The second roll 2 is the metal roll which is also internally provided with a heating source 3*b*. At least one of rolls 1 and 2 is provided with a temperature detection end 6 for the purpose of temperature control.

In the periphery of the second roll 2, there are arranged a releasing agent supply member 8 composed of Teflon, felt or the like of which one end is immersed into a releasing agent 7 and for supplying the releasing agent on the surface of roll, and a blade 9 for uniformly controlling a supply of the releasing agent.

The heating contacting and fixing apparatus construction as mentioned above has features, which will be explained in order as follows.

First, in order to raise temperatures of the first and second rolls 1, 2 to desired temperature, at least the heating source 3*b* within the second roll or the heating sources 3*a* and 3*b* within the first and second rolls 1, 2, respectively, are heated. In this case, the quantity of heat is suitably distributed so that more heat is applied to the second roll 2 having a metal surface and both the rolls 1 and 2 are brought into contact with each other for rotation in a well-known manner, whereby the silicone rubber 5 round the first roll 1 may be heated internally and externally. Hence, the temperature gradient within the silicone layer 5 is small and the rising speed of the surface temperature of the silicone rubber 5 is increased, and in addition, heat required to heat the metal core 4 of the first roll 1 is prevented from being consumed more than needed. At this time, the releasing agent 7 containing a functional group is supplied to the second roll 2 and to the silicone layer 5 of the first roll 1.

After both the rolls 1 and 2 have reached the desired temperature, the temperature is controlled by the temperature control device 6. Since the consumption of electric power in a normal operation is less than that consumed at the time of temperature rise or at the time of passage of the paper to be fixed, it is not necessary to place both the rolls 1 and 2 in a condition of contact and rotation so that a difference of temperatures within the silicone rubber 5 may be maintained small.

Next, both rolls 1 and 2 are brought into contact with each other before the paper to be fixed bearing a toner image 11 subjected to fixation in a fixing process is reached a fixing device to thereby permit the paper 10 to pass through, for fusion, a contact or nip portion 12 formed between the rolls 1 and 2. Incidentally, since both front and back surfaces of the paper 10 to be fixed receive heat, the temperature gradient and also the viscosity gradient within the toner image 11 are gentle to provide a good condition in order to avoid at least offset. In this case, since the surface of the first roll 1 is formed with silicone 5 having a good releasing property and coated with a releasing material 7, it is not necessary to particularly raise the temperature in the vicinty of a contact surface between the toner image and the paper 10 to be fixed to a level higher than the temperature of a contact surface between the toner and the first roll 1.

Where the first and second rolls 1 and 2 are designed to have silicone and a metal surface, respectively, as seen in the apparatus according to the present invention, if the surface temperatures are set to be the same, the quantity of heat transmitted from the first roll 1 to the paper 10 and toner image 11 is about one half ($\frac{1}{2}$) of the second roll 2 in terms of thermal conductivity, while the first roll 1 is greater in the surface temperature drop in terms of temperature conductivity. This temperature and quantity of heat may be recovered by the heating sources 3*a* and 3*b*. However, the surface temperature of the first roll 1 is supplied between the paper 10 to be fixed and a subsequent paper 10' to be fixed from the metal surface of the second roll 2 so that the quantity of heat supplied from the heating source 3*a* within the first roll 1 is less than the quantity transmitted at a contact portion 12 to the paper 10 to be fixed and the toner image 11. Therefore, an absolute temperature rise within the silicone rubber 5 round the first roll 1 is extremely effective against at least thermal deterioration of silicone and primer. It will of course be noted that the desired temperatures of the first and second rolls 1, 2 are not necessarily the same temperature but the second roll 2 may be set somewhat higher to avoid thermal deterioration of silicone.

As disclosed in Japanese Pat. Laid-Open No. 39,554/1975, the quantity of heat generated from the heating sources 3*a* and 3*b* may also be controlled in accordance with a given relationship so that the temperature within the toner layer may substantially be maintained constant.

It will be understood that the releasing agent 7 may be supplied from the second roll 2 to the first roll 1 even between the paper 10 to be fixed as previously mentioned.

As described above, the second roll 2 is formed into a roll having a metal surface, whereby the first roll 1 may obtain an effect of external heat to minimize thermal deterioration of the silicone rubber layer 5 and to increase a heat transmission efficiency on the side of the paper 10 to be fixed on the toner image 11, thereby decreasing a possibility of occurring offset at the time of fixing process to obtain copied images of good quality. These advantages can be achieved only by the use of the releasing agent 7 containing a functional group according to the present invention to obtain a stabilized performance for a long period of time.

That is, adhesion of the toner image 11 already fused on the back of the paper 10 to be fixed, paper powder on the paper to be fixed, the toner particles floating in the vicinity of the fixing device, and the toner offset to the first roll, to the second roll having a metal surface can be avoided by the presence of a cross link thin layer formed by the reaction between the functional group contained in the releasing agent 7 and the metal to always maintain a fresh metal surface, whereby a stabilized fixing process may be maintained for a long period of time. In addition, also in the first roll 1, the releasing agent 7 has no reactivity with respect to the silicone rubber 5, but the offset phenomenon may be minimized by the low surface energy characteristic inherent in the silicone and the function inherent in the releasing agent.

Further, since the toner has a wide distribution in molecular weight, there is possibility that offset may occur however hard you may control the surface temperature of rolls. However, if the quantity thereof is small, it may be re-transferred to the paper 10' to be fixed subsequently fed. The surface may accurately by maintained in its initial condition by the provision of a cleaning roll 13 at least on either of the first and second rolls 1, 2, as shown in the FIGURE. The surface of the cleaning roll 13 may comprise metal having no reactivity with a functional group within the releasing agent 7, for example, such as stainless steel and the like, or thermoplastic resins and the like having the same quality as that of toner.

EXAMPLE

The first roll 1 has an aluminum core 4 of which surface is coated with 1.5 mm thick of HTV (KE-530 of Shin-etsu Chemical make) to form a coated layer 5 having a diameter of 30 mm while the second roll 2 comprises a copper pipe, wall thick 3 mm × diameter 30 mm. It was assumed that the surface speed is 100 mm/sec., feed speed of paper 10 to be fixed is 1000 copies/hour, and the surface temperature of the rolls 1 and 2 is 140° C. It was assumed that the maximum 400W may be applied to the heating source 3*a* of the first roll 1 and the maximum 600W to the heating source 3*b* of the second roll 2. In the case of the releasing agent 7, which comprises polyalkylsiloxane containing a mercapto group, the rise time to the desired temperature was about two and half minutes and heat loss in normal condition was 180 W for both rolls. The paper 10 to be fixed was fed under these conditions, and as a result, good fixing performance was obtained, consumption electric power being 170 W for the first roll while 300 W for the second roll. The average temperature at the adhesive surface between the silicone coated layer 5 and the core 4 was 155° C. Unserviceable copies due to separation of the silicone coated layer 5 from the core 4 have appeared after more than 100,000 to 150,000 copies have been produced, and during that time, no lowering in performance due to offset or the like has been found. In the case where the temperature has been controlled in a given relation (in this case, surface temperature of the first roll + surface temperature of the second roll = constant) as previously described, fixing condition has been stabilized.

It will be understood from the foregoing that employment of arrangement wherein the first roll 1 is coated with silicone rubber and the second roll 2 comprises a metal roll and the parting agent 7 comprises a material having a functional group may provide a heating, contacting and fixing device which is higher in thermal efficiency, service life and reliability than is obtained by prior art devices.

What is claimed is:

1. Apparatus for fixing toner images to copy substrates, said apparatus comprising:

a first roll including an elastomeric outer layer;

a second roll contacting said first roll and cooperating therewith to form a nip through which said copy substrates pass with said toner images contacting said elastomeric outer layer;

means supported internally of said first roll for elevating the surface temperature thereof;

means disposed internally of said second roll for elevating the surface temperature thereof directly and indirectly serving to assist said means disposed internally of said first roll to thereby elevate the surface temperature of said first roll;

said elastomeric layer comprising silicone rubber and said second roll being fabricated from metal; and means for applying a functional release agent fluid to the surface of said second roll and subsequently to said first roll through contact of said second roll with said first roll.

* * * * *